US006616621B1

(12) United States Patent
Kohr

(10) Patent No.: US 6,616,621 B1
(45) Date of Patent: Sep. 9, 2003

(54) MASSAGING DEVICE

(75) Inventor: Oliver Kohr, Karlsruhe (DE)

(73) Assignee: Dr. Kohr GmbH & Co. Medizintechnik, Tiefenbronn (DE)

( * ) Notice: Subject to any disclaimer, the term of this patent is extended or adjusted under 35 U.S.C. 154(b) by 0 days.

(21) Appl. No.: 09/619,396

(22) Filed: Jul. 19, 2000

(30) Foreign Application Priority Data

Mar. 23, 2000 (DE) ..... 200 05 475 U

(51) Int. Cl.[7] ..... A61H 23/02
(52) U.S. Cl. ..... 601/72; 601/108; 601/112
(58) Field of Search ..... 601/46, 48, 70–73, 601/80, 81, 97, 89, 101–112, 90–96, 135–138; 600/38

(56) References Cited

U.S. PATENT DOCUMENTS 3,841,321 A * 10/1974 Albach et al. ..... 601/72
4,632,095 A * 12/1986 Libin ..... 601/135
4,964,398 A * 10/1990 Jones ..... 601/101
5,300,095 A * 4/1994 Salazar ..... 601/21
5,925,002 A * 7/1999 Wollman ..... 601/70
6,027,444 A * 2/2000 Franck ..... 600/38
6,084,400 A * 7/2000 Steinich et al. ..... 324/207.13

* cited by examiner

*Primary Examiner*—Danton D. DeMille
*Assistant Examiner*—Quang D Thanh
(74) *Attorney, Agent, or Firm*—Darby & Darby

(57) ABSTRACT

A massaging device includes a motor integrated with a housing, a shaft for transmitting the motor motion, a treatment head attachable to the shaft. The rotational speed of the motor can be measured as part of a control circuit. The rotational speed provides an actual value to the control circuit. A setpoint of the rotation speed of the motor can be manually adjusted. The control circuit is designed so that the current supplied to the motor is controlled depending on the difference between the instantaneous actual value and the selected setpoint.

15 Claims, 1 Drawing Sheet

MASSAGING DEVICE

BACKGROUND OF THE INVENTION

1. Field of the Invention

The invention relates to a massaging device, in particular a massaging device suitable for self-treatment.

2. Description of the Related Art

A number of massaging devices are commercially available adapted to be used by both a lay person as well as by trained physical therapist. Such devices generally have an electric motor, a mechanical unbalanced mass (with or without gear shaft, crank gear, toothed gear or alike), a power supply or standard batteries or rechargeable batteries for supplying power, as well as one or several treatment heads, also referred to as actuators, adapted to introduce the mechanical oscillations produced by the motor in the tissue and/or the skin. In addition, larger devices frequently include a control unit that converts the high voltage to a low voltage and also includes electronics for producing the mechanical oscillations (motor control).

Examples of commercially available devices are: finger massaging devices, percussion massaging devices, vibrating massaging devices, neural-muscular stimulation devices, devices for matrix rhythm therapy (MRT), as well as a bio-mechanical stimulation devices.

The so-called finger massaging devices have the advantage of providing a gentle treatment, wherein the relatively small effective forces produce only a minimum depth effect. Accordingly, the therapeutic effect may be relatively small, requiring longer treatment times for each indication. Such finger massaging device is described, for example, in the catalog of the firm Proldee (Spring 2000).

Percussion massaging devices are available with oscillation amplitudes up to approximately 10 mm, producing an excellent depth effect. However, the oscillations cannot be introduced into the fibers of the muscle-tendon apparatus (MTA), preventing the muscle and tendon fibers from being intentionally passively extended and relaxed, nor can the activation and excitation dynamics of the MTA be influenced. In addition, the treatment heads are relatively large so that it is difficult to work in a small area, for example on body parts that provide only limited access.

Vibrating massaging devices are available with dome-shaped, cylindrical or curved vibrating heads and/or treatment heads. Random oscillations with a relatively small depth effect are produced. The oscillation frequency is typically the line frequency or a multiple thereof. Such massaging devices are available, for example, under the name "Massagekäfer" from the company Schupp.

Neural-muscular stimulation devices produced defined oscillations with a large depth effect. Such a device is described, for example, in DE 198 4 1 273.

DE 44 43 756 C1 describes a device for matrix rhythm therapy. However, such devices do not have enough power to allow successful targeted treatment under load, since the frequency cannot be controlled to remain constant when the massaging head is under load.

The design of bio-mechanical stimulation devices is similar to those for matrix rhythm therapy. Significantly different is the shape of the treatment head (the outside contour corresponds to an Archimedean screw). This, however, does not significantly affect the success of the treatment. The motion of the treatment head does not effectively target the tissue and/or the muscles, so that the therapeutic effect tends to be limited.

All these devices have in common that under load, i.e., when the treatment head is pressed onto the surface of the skin and the underlying tissue at an elevated pressure, the rotation speed of the motor and therefore also the frequency of the treatment head decreases. This makes the devices less efficient.

SUMMARY OF THE INVENTION

It is therefore an object of the invention to provide a massaging device wherein the rotation speed of the motor and therefore also the frequency of the treatment have is maintained at a constant value within a narrow range even under load.

The massaging device according to the invention includes a motor integrated with a housing, a shaft for transmitting the motor motion, a treatment head attachable to the shaft, and means for directly measuring the rotation speed of the motor, with the means being part of a control circuit, wherein the means for directly measuring the rotation speed provides an actual value to the control circuit, wherein a means is provided on the housing for manually adjusting a setpoint of the rotation speed of the motor, and wherein the control circuit is designed so that the current supplied to the motor is controlled depending on the difference between the instantaneous actual value and the selected setpoint.

With a massaging device according to the invention, the frequencies produced by the motor and converted into oscillations can be effectively transmitted to the tissue. The control circuit, which for example consists of an electronic circuit, regulates the rotation speed of the motor very precisely. In other words, the rotation speed remains at the preset value independent of the value of the pressing force with which the treatment head of the massaging device is pressed against the skin. The measurement circuit of the control circuit is formed by a means for directly measuring the rotation speed and has therefore a very simple construction. A direct measurement of the rotation speed is superior to an indirect measurement of the motor rotation speed through secondary effects, for example by using the induced counter force in the electric motor, as described, for example, with reference to the neural-muscular stimulation devices disclosed in DE 198 41 273. The set motor speed of the massaging device according to the invention can be maintained within a range of +/−2.86%, referenced to the full-scale value. The device according to the invention is not only easy to handle, which is particularly appreciated by a lay person, but is also more effective for the therapy because the frequency remains constant under load. Hence, these defensive oscillations can produce a targeted stimulation in the tissue.

The means for directly measuring the rotation speed is preferably an angle encoder capable of measuring the actual rotation speed of the motor during the operation. Such an angle encoder or angle sensor essentially consists of a shaft and a disk to which a code pattern is applied. Depending on the type of code pattern, the angular velocity can be sensed by electric, optic or magnetic means. The angle encoder is also a simple and effective means for measuring the actual rotation speed of the motor during the operation.

According to a preferred embodiment, a gear is provided between the motor and the shaft for converting the rotation motion of the motor into a oscillatory motion. The motor revolutions are thereby converted into planar oscillation that can be effectively coupled into the tissue. Such a gear can be implemented, for example, by using only two components, namely a shaft and an eccentrically drilled sleeve. Due to the small number of components, this crank gear has a long lifetime. The massaging device with a gear of this type has therefore a total of two shafts, a drive shaft located between the motor and the gear, and a driven shaft adapted to receive a treatment head on the end facing away from the gear. The shaft and the treatment head can also be designed so as to provide a sizable friction between the two elements, thereby preventing the treatment head from inadvertently becoming detached during the treatment. Alternatively, a latching mechanism can be provided. Such mechanisms are known in the art and will therefore not be described in detail.

According to a particularly preferred embodiment, the means for adjusting a setpoint of the rotation speed of the motor can be a slider switch, a rotary switch or a pushbutton switch. Such a slider switch, rotary switch or pushbutton switch can also be used for switching the device ON and OFF and for selecting fixed frequencies. A slider switch with four positions has been found to be particularly suitable for home use, wherein one switch position corresponds to the OFF-position of the device and the three other switch positions correspond to different frequencies. With respect to the motion of the treatment head, these values can be, for example, 0 Hz (for the off-position) and values between approximately 8 Hz and 35 Hz for the different frequencies settings. This arrangement is intended to eliminate operator errors during operation.

Alternatively or in addition, an electronic circuit can be provided which can be used to input a programmed sequence of frequencies into the device and to execute this programmed sequence. The electronics can also be designed so that the sequence of frequencies is preset in the factory.

In another advantageous embodiment, to facilitate use particularly for a lay person, a means is provided for measuring the motor current. This arrangement provides a so-called overload protection for preventing an overload condition in the electronics and the mechanical components (gear and motor) as well as a local overload of the tissue. The means can be implemented in form of conventional current meters. The actual control in the event of an overload can be performed either manually or automatically by the device.

It is also feasible alert the operator to an overload condition, e.g., if the means for measuring the motor current indicates a current that exceeds a predetermined threshold value, through an optical and/or acoustical signal: A light emitting diode or an acoustic signal transmitter, such as a buzzer, may be provided on the housing of the device, with a current being supplied to the light emitting diode or the acoustic signal transmitter when the motor current exceeds a predetermined threshold value. The operator can then decrease the pressing force to prevent an overload not only of the device, but also of the skin and/or the tissue of the person to be treated. The threshold value above which the means indicate an overload, should be determined empirically based on experiments conducted by the manufacturer. The threshold value is composed of the duration of the force applied to the tissue and the actual force value. A first limit value is to be determined above which the tissue can be damaged, and a second limit value which takes into account the sensitivity of the tissue. The lower of these two limit values is then set as the threshold value for the overload protection.

Alternatively or in addition to providing an optical or acoustic signal transmitter on the device, the means for measuring the motor current can be connected to the control circuit so as to the control the motor rotation speed to assume a value of zero when the motor current exceeds a predetermined threshold value. This arrangement provides an automatic protection against overload. Several possibilities exist for the exact implementation of the automatic control: for example, the current supply to the device can be interrupted for a predetermined time, for example for 10 to 20 seconds. The device could also be disconnected automatically. Appropriate circuits can be readily implemented by those skilled in the art and are therefore not described in detail.

The massaging device can have one or several different treatment heads. Advantageously, the treatment heads can be cone-shaped or cam-shaped. Treatment heads with this shape are not only easy to operate but also tend to cause the least damage if the device is not properly operated. However, other shapes are possible depending on the purpose of the treatment, but the moment of inertia of the heads must be symmetric to prevent unbalances which could adversely affect the device itself as well as its operation.

Preferably, the at least one treatment head is made of a bio-compatible or food-compatible plastic or hard rubber. Such material has the advantage that it can be easily cleaned and is therefore hygienic, easy to form and skin-compatible. These materials have the additional advantage that they can be easily dyed so that treatment heads with a wide range of colors can be produced.

According to another advantageous embodiment, the housing is formed as an elongated handle section, wherein the motor is arranged in the housing center in relation to the longitudinal axis of the housing. The motor and the drive, respectively, which is typically the portion of the device with the greatest mass, is then located in the center or proximate to the center of mass of the device. The center of mass is preferably located inside the gripped surface which the user holds in his hand. This arrangement facilitates handling of the device, in particular for treating large muscle groups, and is less tiring for the user.

In order to keep the weight of the device as low as possible, the device is preferably supplied from an external power source, since rechargeable bakeries or other batteries are heavy and would make the device too heavy. Accordingly, the device preferably has its own mains power supply which is adapted to be connected to the power mains, but is preferably not part of the device. Alternatively or in addition, the device may be supplied with power by incorporating internal standard or rechargeable batteries in the device itself.

Like the treatment head, the housing can also be made of a bio-compatible or food-compatible plastic or a metal.

To enable a firm grip of the device, the outside of the housing can include longitudinal grooves extending transversely to the longitudinal axis of the housing. This arrangement reduces the possibility that the hand of the user slips on the handle and eliminates another source that could cause injury. Depending on the type and form of the housing, such grooves or projections or ribs can also be placed at a different location or can extend in different direction.

The massaging device of the invention can be used in different ways:

1. Point-wise operation at a point, e.g., a trigger point, with or without intentional movement of the patient;
2. Working parallel along the direction of the fibers of muscles and tendons, with or without intentional movement of the patient;
3. Working perpendicular to the direction of the fibers of muscles and tendons, with or without intentional movement of the patient In the first approach, the treatment head is gently pressed against a point, for example, the origin of the tendon, the trigger point, etc. The tolerance level for pressure is different from person to person.

In conjunction with the second approach, the device is guided unidirectionally along the direction of the fiber with a pressure of the treatment head adapted to the tolerance level for the individual. In this form of treatment, the tolerance threshold for pressure is also different from person to person. The treatment head is withdrawn at the fiber end and returned to the starting point. There is no back and forth motion. To speed up the success of such therapy, the person to be treated can intentionally move the respective MTA.

In conjunction with the third approach, the device is guided unidirectionally perpendicular to the direction of the fiber with a pressure of the treatment head adapted to the tolerance level for the individual. The treatment head is withdrawn at the fiber end and returned to the starting point. There is no back and forth motion. To speed up the success of such therapy, the person to be treated can intentionally move the respective MTA.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

DETAILED DESCRIPTION OF THE PRESENTLY PREFERRED EMBODIMENTS

Figure 1:
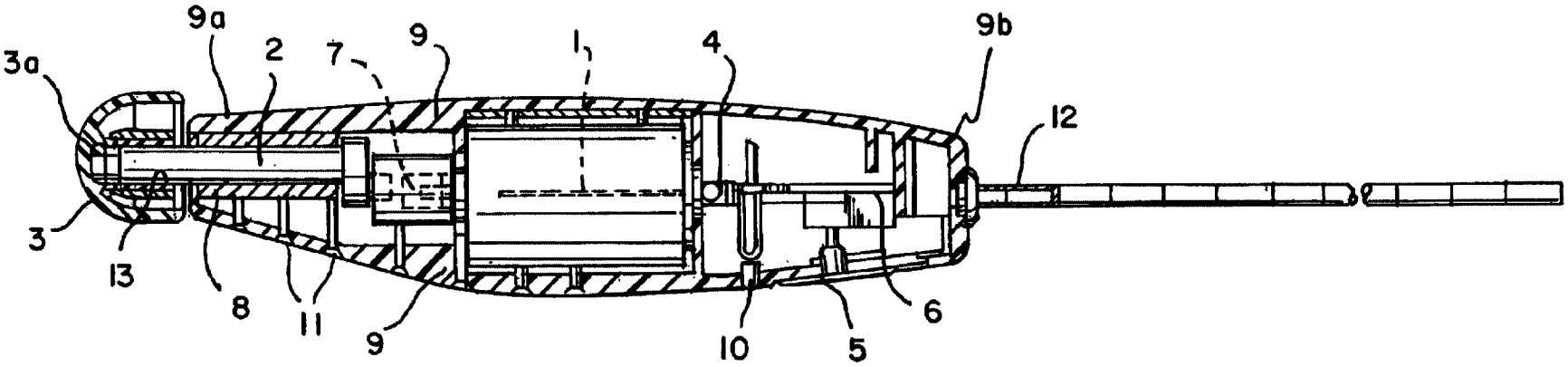
FIG. 1 shows a cross-sectional view of a preferred embodiment of the massaging device.

According to the preferred embodiment, the massaging device includes a motor 1 which is positioned centrally inside the device. The movement of the motor is transmitted to the outside by a shaft 2 adapted to receive a treatment head 3. For this purpose, the treatment head has a cutout 3*a*, with the form and dimensions of the cutout substantially corresponding to the form and dimensions of the shaft 2.

A means 4 for directly measuring the rotation speed of the motor is a disposed on the side of the motor facing away from the treatment head. In the present embodiment, the means is implemented as an angle encoder. Externally to the device, a means 5, in the present example in the form of a switch, is provided for manually adjusting the setpoint of the rotation speed of the motor. The switch is connected to an electric circuit 6 which in the present example is arranged on a printed circuit board in the rearward section of the device. A gear 7, for example a conventional crank gear, is located between the motor 1 and the shaft 2 which in the present example operates as a driven shaft, with the gear converting the rotary motion of the motor into an oscillatory motion. The oscillatory motion is transmitted by the shaft 2 to the connected treatment head 3. The driven shaft 2 is supported in a bearing sleeve 8 which is specifically designed for such oscillatory motion and hence provides a long lifetime of the shaft. All moving parts of the massaging device of the invention, in particular the gear 7 and treatment head 3 are designed to have no unbalances, so that the produced oscillations are only weakly transmitted to the operator.

To reduce wear on the crank gear, the illustrated embodiment has a driving pin with an eccentric bore 13.

The motor 1, the gear 7, the electronics 6, as well as portions of the shaft 2 are integrated in a housing 9 which is preferably made of a bio-compatible and/or food-compatible plastic or hard rubber. The housing has an elongated shape that is conically tapered to the front end 9*a* of the housing 9. The ergonomic form of the housing of the massaging device of the invention enables easy handling and long operation without tiring the operator. The motor 1 and the gear 7 are arranged symmetrically with respect to the longitudinal axis of the housing 9 to reduce mechanical unbalances.

A light emitting diode 10 may be disposed at a suitable location, in the present example immediately next to the switch, to indicate when the device is switched ON and/or also a possible overload condition of the device. A multi-color diode can also be used which may emit green light when the device is switched on and red light when the device is overloaded. The light emitting diode 10 is connected in a suitable manner-with electronics of the circuit 6. Alternatively, several light emitting diodes, for example two light emitting diodes, can be provided to separately indicate an operating state and an overload condition.

Several longitudinal grooves 11 can be formed in the front half of the housing to facilitate handling of the device. Alternatively, instead of longitudinal grooves, projections, e.g., ribs, such as rubber, rubberized coatings, two-component molded parts, can also be used. The massaging device according to the invention is connected to an outlet (not shown) via a connecting cable 12 for connecting the device to an external power supply. Since no internal power supply, such as a standard battery or rechargeable battery, is required, the device itself can be small, lightweight and easy to handle.

To further increase the comfort for the user, the rearward end 9*b* of the housing can have a stress relief, for example in the form of a spiral with cable support. Bending of the cable can be prevented by a rubber sleeve or a special embossed portion of this housing section.

When the massaging device according to the invention is operated, the switch is initially placed in a position that corresponds to a specified frequency. When the device is switched ON, the light emitting diode 10 emits green light. The circuit 6 controls the motor at the set frequency, with the angle encoder continuously measuring the rotation speed of the motor 1 and supplying this signal to the electric circuit 6. The user can then place the treatment head 3 on the skin of the person to be treated by applying a variable pressing force. The pressing force increases the load on the motor; however, the control circuit maintains the rotation speed of the motor at a constant value. The rotation speed of the motor 1 is controlled by increasing the current with increasing pressing force. The supplied current can be measured by suitable means (not shown) that transmit a corresponding signal to the electric circuit. The electric circuit compares this signal with a predetermined threshold value. If the motor current exceeds this threshold value, then the selected pressing force is too high and could cause the device to overload. The electric circuit then automatically and controllably decreases the rotation speed towards zero, causing the light emitting diode 10 to emit red light. This indicates to the user that the rotation speed has been controllably reduced due to an impending overload. The circuit 6 can be designed so that the device either has to be switched off and then switched on again, or to automatically control the rotation speed of the motor so that the motor returns to the set frequency when the pressing force is reduced.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A massaging device, comprising:

a housing;

a motor disposed in said housing, a shaft for transmitting rotational motor motion, a treatment head attachable to said shaft, means for directly measuring the rotation speed of the motor, said means being connected to a control circuit, wherein said means for directly measuring the rotation speed. provides an actual value of motor rotational speed to said control circuit, means disposed on said housing for manually adjusting a setpoint of the rotation speed of said motor; and wherein said control circuit controls the current supplied to said motor as a function of the difference between the instantaneous actual value and the adjusted setpoint, the motor rotational speed.

2. The massaging device according to claim 1, wherein said means for directly measuring the rotational speed of said motor is an angle encoder.

3. The massaging device according to claim 2, further comprising a gear disposed between said motor and said shaft for converting the rotational motion of the motor into oscillatory motion.

4. The massaging device according to claim 3, wherein said means for adjusting the setpoint of the rotation speed of said motor is one of a slider switch, a rotary switch and a pushbutton switch.

5. The massaging device according to claim 4, wherein the slider switch can be set to a least four positions.

6. The massaging device according to claim 5, further comprising a means for measuring the motor current.

7. The massaging device according to claim 6, further comprising a light emitting diode disposed on said housing, a current being supplied to said light emitting diode when the motor current exceeds a predetermined threshold value.

8. The massaging device according to claim 7, further comprising an acoustic signal transmitter, which is supplied with a current when the motor current exceeds a predetermined threshold value.

9. The massaging device according to claim 8, wherein said means for measuring the motor current is connected to said control circuit so that the motor rotation speed controllably assumes a zero value when the motor current exceeds a predetermined threshold value.

10. The massaging device according to claim 9, wherein said treatment head is at least one of a cone-shape and a cam-shape.

11. The massaging device according to claim 10, wherein at least one treatment head is made of one of a bio-compatible, food-compatible plastic and hard rubber.

12. The massaging device according to claim 11, wherein said housing is formed having an elongated handle section, and said motor is arranged in an intermediate portion of said housing with respect to the longitudinal axis of said housing.

13. The massaging device according to claim 12, wherein said housing is made of at least one of a bio-compatible, food-compatible plastic and a metal.

14. The massaging device according to claim 13, wherein said housing is provided on its upper side with longitudinal grooves extending transversely to the longitudinal axis of said housing.

15. The massaging device of claim 12 wherein said treatment head extends from one end of said housing and said means for directly measuring the motor rotation speed is located between said motor and the other end of said housing.

* * * * *